US005371804A

United States Patent [19]

Bauer

[11] Patent Number: 5,371,804

[45] **Date of Patent: * Dec. 6, 1994**

[54] VOICE TRANSMISSION SYSTEM

[75] Inventor: Alfred Bauer, Parma, Ohio

[73] Assignee: Actron Manufacturing Company, Cleveland, Ohio

[ * ] Notice: The portion of the term of this patent subsequent to Aug. 11, 2009 has been disclaimed.

[21] Appl. No.: 792,804

[22] PCT Filed: Nov. 15, 1991

Related U.S. Application Data

[63] Continuation-in-part of Ser. No. 758,707, Sep. 9, 1991, Pat. No. 5,138,666, which is a continuation of Ser. No. 433,601, Nov. 8, 1989, abandoned, which is a continuation-in-part of Ser. No. 430,091, Oct. 27, 1989, abandoned, which is a continuation of Ser. No. 186,932, Apr. 27, 1988, abandoned, which is a continuation-in-part of Ser. No. 134,934, Dec. 18, 1987, Pat. No. 4,901,356.

[51] Int. Cl.[5] ..... H04R 25/00

[52] U.S. Cl. ..... 381/169; 381/168; 381/183; 381/187

[58] Field of Search ..... 381/169, 168, 183, 187, 381/75; 379/430; 181/22, 21; 2/422; 24/17.13; 128/201.19; 411/418, 419

[56] References Cited

U.S. PATENT DOCUMENTS

| | | | |
|---|---|---|---|
| 1,139,177 | 5/1915 | Ganzer | 379/430 |
| 1,242,672 | 10/1917 | Finley . | |
| 1,344,349 | 6/1920 | Mickelson | 379/430 |
| 1,656,914 | 1/1928 | Hart | 181/22 |
| 1,666,216 | 4/1928 | Moulat | 411/418 |
| 2,123,196 | 7/1938 | Millard . | |
| 2,165,856 | 7/1939 | Howey . | |
| 2,847,506 | 8/1958 | Gray et al. . | |
| 2,942,072 | 6/1960 | Cunningham . | |
| 2,950,360 | 8/1960 | Duncan . | |
| 2,953,129 | 9/1960 | Bloom et al. . | |
| 3,180,333 | 4/1965 | Lewis . | |
| 3,181,531 | 5/1965 | Angioletti . | |
| 3,243,511 | 3/1966 | Erdmann et al. . | |
| 3,310,736 | 3/1967 | Bayly et al. . | |
| 3,314,424 | 4/1967 | Berman | 128/201.19 |
| 4,985,922 | 1/1991 | Kolbert | 380/59 |
| 5,060,308 | 10/1991 | Bieback | 379/154 |
| 5,138,666 | 8/1992 | Bauer et al. | 381/169 |
| 5,224,473 | 7/1993 | Bloomfield | 128/201.19 |

(List continued on next page.)

FOREIGN PATENT DOCUMENTS

| | | | |
|---|---|---|---|
| 492664 | 9/1938 | United Kingdom | 381/187 |
| 549518 | 11/1942 | United Kingdom | 381/187 |
| 2165721A | 4/1986 | United Kingdom . | |

OTHER PUBLICATIONS

"A Respirator-Compatible Communication Device", R. A. deRoza, et al., Lawrence Livenmore National Laboratory, Sep. 20, 1982.

(List continued on next page.)

*Primary Examiner*—Curtis Kuntz
*Assistant Examiner*—Jason Chan
*Attorney, Agent, or Firm*—Calfee Halter & Griswold

[57] ABSTRACT

A voice transmission system for a conventional gas mask or face mask includes a body enclosing a microphone, an amplifier assembly and a speaker. The microphone is mounted within a cavity formed in the body, while the amplifier assembly and speaker are mounted within a main compartment of the body. The microphone, amplifier assembly, speaker and a set of batteries are electrically interconnected. The batteries are enclosed within one or more battery compartments in the body. A mounting assembly having a bracket with threaded, resilient segments is also connected to the body. The resilient segments of the bracket are designed to releasably couple the body to the voice emitter passage of the mask without penetration or structural modification of the mask. The voice transmission system is designed to receive a person's voice from a voice diaphragm located in the voice emitter passage of the mask, amplify the voice, and externally transmit the voice through the speaker.

41 Claims, 5 Drawing Sheets

U.S. PATENT DOCUMENTS

| | | | |
|---|---|---|---|
| 3,659,056 | 4/1972 | Morrison et al. . | |
| 3,736,379 | 5/1973 | Kagan . | |
| 3,765,748 | 10/1973 | Branch et al. | 381/68 |
| 3,850,168 | 11/1974 | Ferguson et al. | 381/169 |
| 3,881,056 | 4/1975 | Gibson et al. | 381/169 |
| 4,010,334 | 3/1977 | Demeter . | |
| 4,072,831 | 2/1978 | Joscelyn | 381/169 |
| 4,194,096 | 3/1980 | Ramsey | 381/169 |
| 4,237,341 | 12/1980 | Richards | 381/75 |
| 4,258,229 | 3/1981 | Eggert et al. . | |
| 4,374,301 | 2/1983 | Frieder, Jr. | 379/430 |
| 4,400,591 | 8/1983 | Jennings et al. | 381/75 |
| 4,471,174 | 9/1984 | Nava | 379/430 |
| 4,508,936 | 4/1985 | Ingalls | 128/201.19 |
| 4,683,588 | 7/1987 | Goldberg | 379/430 |
| 4,736,740 | 4/1988 | Parker et al. | 128/201.19 |
| 4,756,308 | 7/1988 | Ryback | 128/201.19 |
| 4,957,106 | 9/1990 | Vandeputte | 128/201.19 |
| 4,961,420 | 10/1990 | Cappa et al. | 128/201.19 |
| 4,980,926 | 12/1990 | Noetzel | 455/617 |

OTHER PUBLICATIONS

Schematic illustration of Actron Voice Transmission System #1.

AudiPack Mask Voice Amplifier–Concept Description & Preliminary Design Specification and attached illustrations.

Photographs of a microphone module/amplifier assembly combination.

Letter to Actron from Bloomfield dated Jul. 16, 1987, describing a VoxAmp voice transmission unit prototype.

"Theory of Operation Gas Mask Electronic Amplifier", Bloomfield Research and Development, Inc.

Photographs of an Archer telephone amplifier.

Draft Agreement between Bloomfield Research & Development, Inc. and Actron Manufacturing Company (unsigned).

VOICE TRANSMISSION SYSTEM

RELATED APPLICATION

This application is a continuation-in-part of application Ser. No. 07/758,707, filed Sep. 9, 1991 and entitled "Voice Transmission System", now U.S. Pat. No. 5,138,666 which is a continuation of application Ser. No. 07/433,601 filed Nov. 8, 1989, now abandoned, which is a continuation-in-part of application Ser. No. 430,091 filed Oct. 27, 1989, now abandoned, which is a continuation of application Ser. No. 07/186,932 filed Apr. 27, 1988, now abandoned, which is a continuation-in-part of application Ser. No. 07/134,934 filed Dec. 18, 1987, and entitled "Voice Transmission System", now U.S. Pat. No. 4,901,356.

FIELD OF THE INVENTION

The present invention relates to voice transmission or communication systems for gas masks or face masks.

BACKGROUND OF THE INVENTION

Protective gas masks or face masks are well known in the art. The masks provide breathing capabilities while protecting the mask user from noxious gases, smoke, etc. However, people wearing the masks often have a need to communicate with one another, particularly during emergency situations. Accordingly, several voice transmission or communication systems have been developed for this purpose.

For example, Lewis U.S. Pat. No. 3,180,333, discloses a gas mask communication system including a generally U-shaped holder connected to the mask. Preferably, the holder includes the amplification speaker in one end portion and the batteries for operating the speaker system in another end portion. The batteries and amplification system are connected in circuit with a microphone inside the mask adjacent the user's mouth. Additional or parallel speakers can be plugged into the Lewis mask communication system including, for example, a speaker attached to the belt of the wearer.

Ingels U.S. Pat. No. 4,508,936, Bloom U.S. Pat. No. 2,953,129, and Duncan U.S. Pat. No. 2,950,360, disclose face mask communication systems having a microphone carried in the face mask and an amplifier or speaker externally coupled to the face mask for support elsewhere, such as around the waist of the user.

The above-identified voice transmission and communication systems however, can have certain disadvantages. For example, the attachment of the amplifier or speaker to the waist can add weight and bulk to the unit and can partially limit the mobility of the wearer. Further, the direction of the amplifier or speaker on the waist does not necessarily follow the direction of the person's head. In other words, as the person turns their head to talk, the direction of the amplifier or speaker on the waist does not necessarily follow the person's head if the body does not simultaneously turn. By having the face and speaker potentially as much as 90° apart in direction, the efficiency and effectiveness of these communication systems can be diminished.

Additionally, during installation (or removal and/or replacement), of some of these systems, the communication system must penetrate and structurally alter the mask in order to reproduce the user's voice. Penetrating and altering the mask however, can raise safety issues, requires additional assembly, and can make it difficult to remove and/or replace the voice transmission system, particularly during emergency situations.

SUMMARY OF THE INVENTION

The present invention provides a lightweight voice transmission system which can be installed (or removed and/or replaced) on a gas mask or face mask without penetrating or structurally altering the mask. Additionally, the voice transmission system, when installed on the gas or face mask, follows the head of the user to maximize the efficiency and effectiveness of the system.

The voice transmission system includes an amplifier assembly, a microphone, and a speaker mounted within a body. The amplifier assembly includes an amplifier circuit board which, along with the speaker, is mounted within a main compartment in the body and enclosed by a perforated end cap. The microphone is mounted within a microphone cavity in the body. The amplifier assembly, microphone, speaker and a set of batteries are electrically interconnected. The batteries are contained in one or more battery compartments in the body having selectively removable covers.

The body of the voice transmission system is designed to be coupled within the emitter passage in the mask. The emitter passage has an existing female threaded section which normally locates a voice diaphragm and a perforated cover. The body includes a mounting assembly with a bracket having resilient, threaded arcuate segments which is designed to be inserted within the emitter passage. Annular ridges on the threaded segments resiliently deflect radially inward as the mounting assembly is inserted into the emitter passage. The threaded arcuate segments engage the threaded section of the voice emitter passage to releasably couple the voice transmission system to the emitter passage adjacent the perforated cover and the voice diaphragm.

The voice transmission system can be coupled to the mask by grasping and forcing or "popping" the bracket into the voice emitter passage, or alternatively by screwing the body onto the mask. Similarly, the system can be uncoupled from the mask by grasping and pulling outwardly on the body, by unscrewing the body from the emitter passage. The system will also uncouple from the mask if impacted from the side with sufficient force. When the voice transmission system is coupled to the mask, the microphone receives the user's voice through the voice diaphragm in the emitter passage. The amplifier assembly then amplifies the voice and externally transmits the voice through the speaker.

Accordingly, it is a basic object of the present invention to provide a compact and lightweight voice transmission system which follows the head of the mask user to maximize the efficiency and effectiveness of the voice transmission system.

It is another object of the present invention to provide a voice transmission system which can be easily coupled to and uncoupled from an existing voice emitter passage of a gas mask or face mask without penetrating or structurally modifying the existing mask. The mounting bracket facilitates attachment without any special tools and without the necessity of making threaded connections.

It is still another object of the present invention to provide a voice transmission system for a gas or face mask which releasably uncouples from the mask if impacted from the side.

Further objects of the present invention will become apparent from the following detailed description and accompanying drawings which form a part of the specification.

DETAILED DESCRIPTION OF THE DRAWINGS

DETAILED DESCRIPTION OF THE PREFERRED EMBODIMENT

Figure 1:
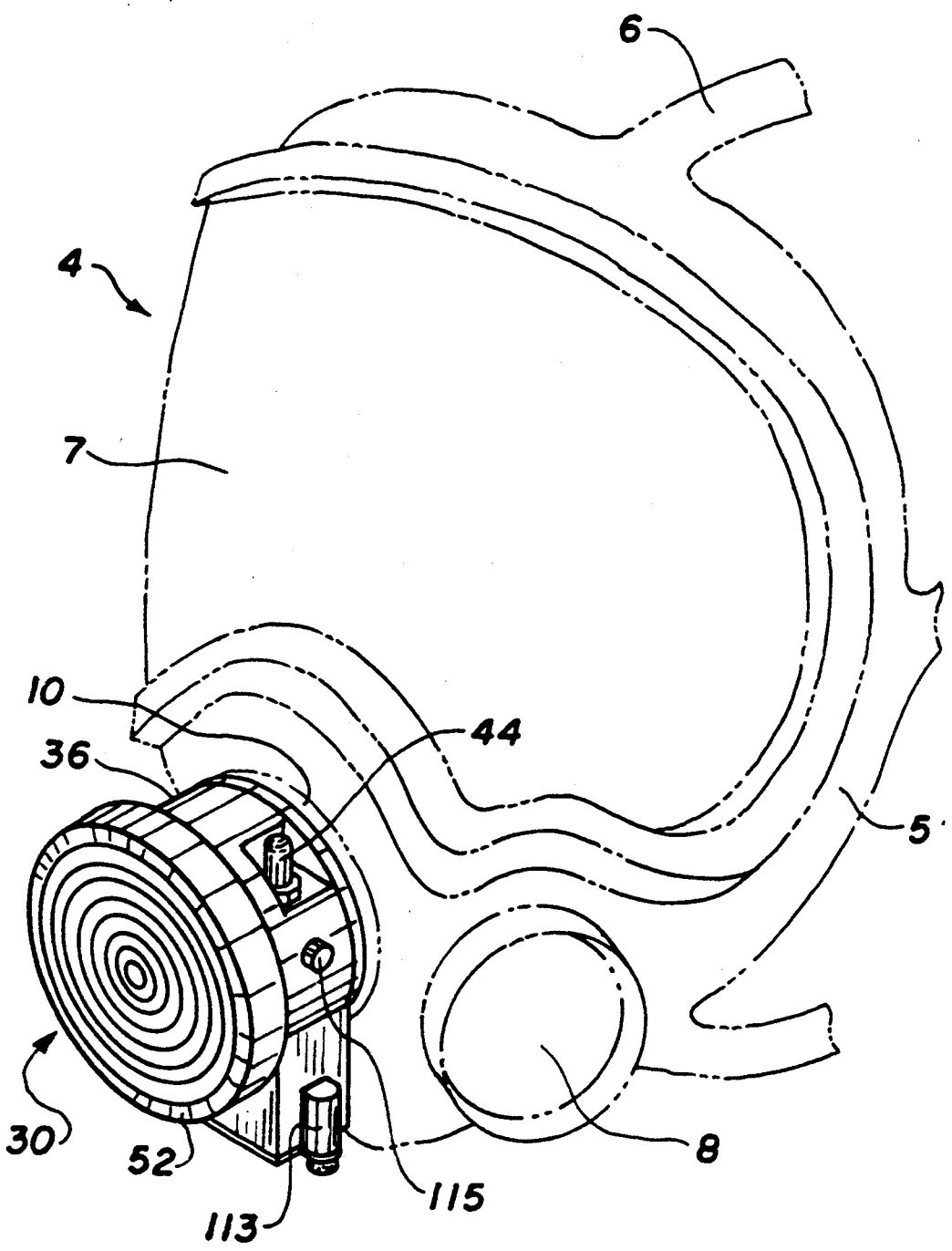
FIG. 1 is a perspective view of the components of the voice transmission system assembled or installed on a gas mask or face mask.
Figure 2:
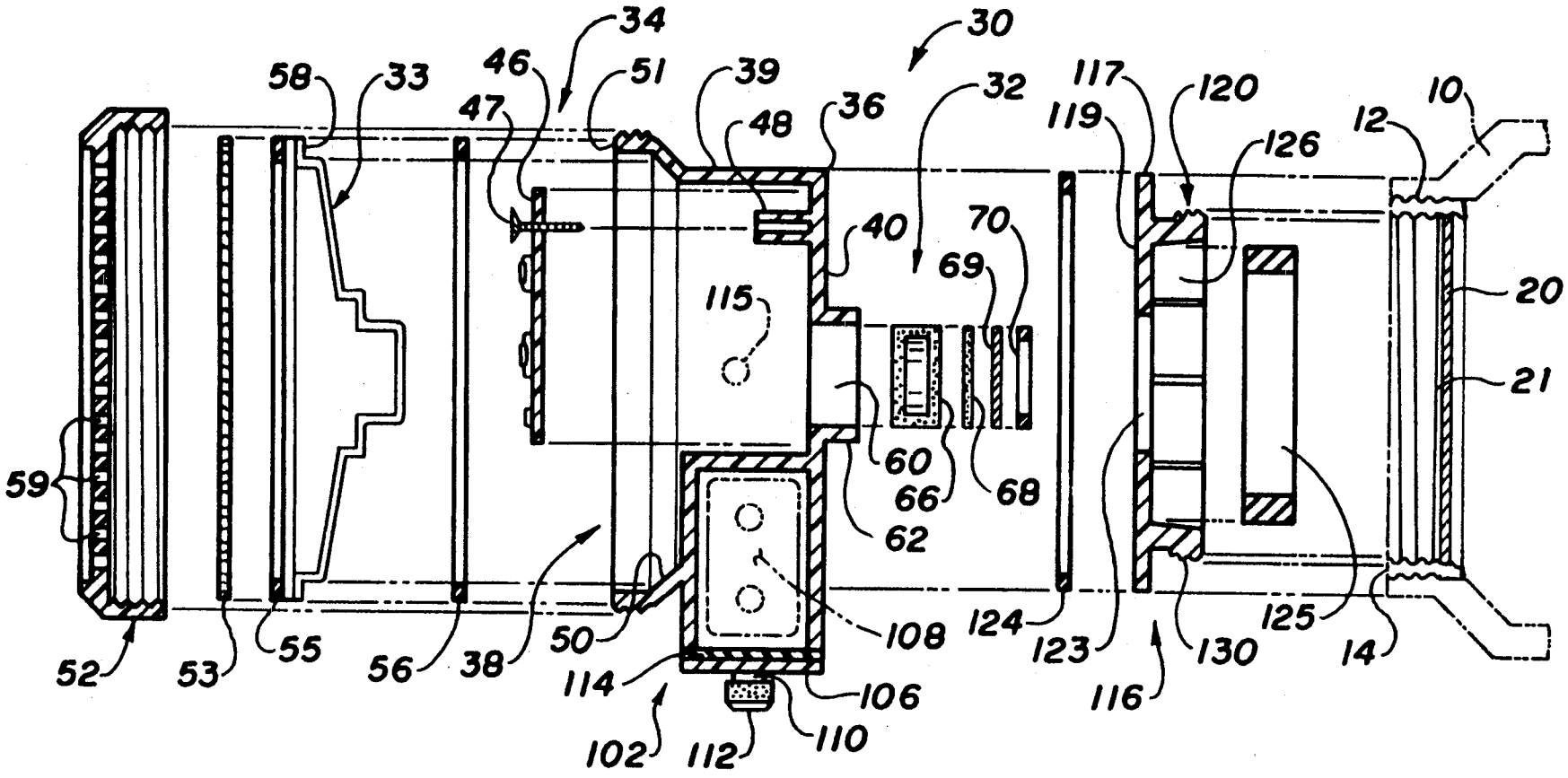
FIG. 2 is an cross-sectional exploded view of the components of the voice transmission system of the present invention prior to assembly or installation on the mask.
Figure 3:
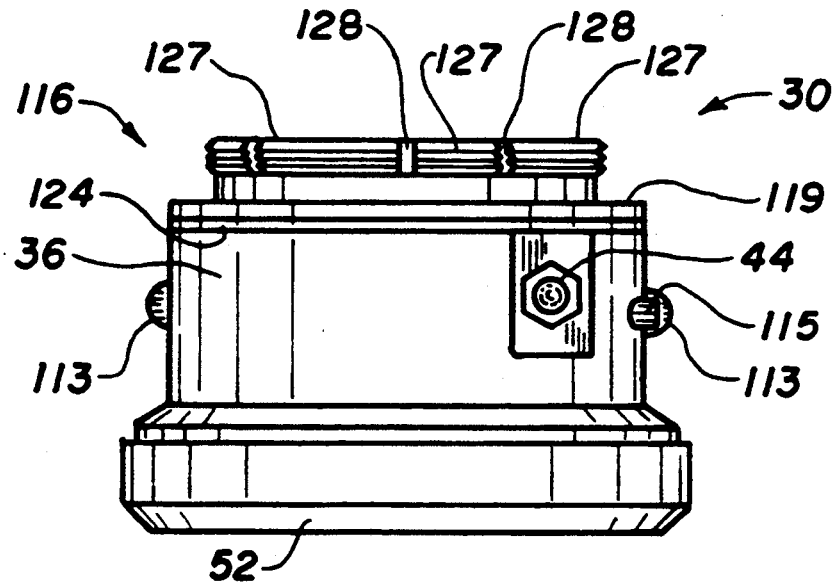
FIG. 3 is a top plan view of the voice transmission system illustrated in FIG. 1 shown removed from the mask.
Figure 4:
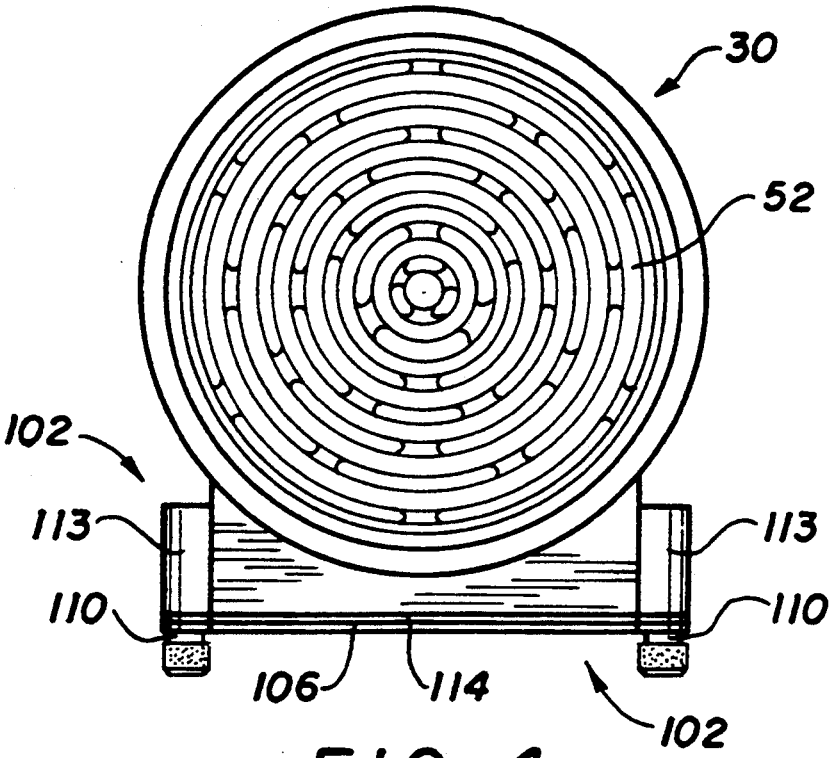
FIG. 4 is a front view of the voice transmission system illustrated in FIG. 3.

Referring to the drawings, and initially to FIGS. 1 and 2, a gas mask or face mask, indicated generally at 4, includes a face piece 5 held tightly against the head of the user by straps 6 encircling the back of the head. A transparent viewing plate 7 is mounted in and sealingly secured to the face piece 5. Upon inhaling, a person wearing the mask 4 receives filtered air drawn through a conventional inhalation port 8 on one side of the mask; and upon exhaling, the person exhausts the air through a conventional exhalation port (not shown) on the opposite side of the mask. The inhalation and exhalation ports have check valves and filters mounted therein (not shown) to prevent noxious gases or contaminants entrained in the air from entering the end of face piece 5 and transparent viewing plate 7, as is generally known in the art.

A person wearing the face mask often needs to communicate with other people in the area. For this purpose, a conventional emitter passage 10 is formed in one piece with the front of the mask 4. The emitter passage 10 includes a threaded inner bore 12. The threads on inner bore 12 normally mate with threads on a diaphragm insert 14. Diaphragm insert 14 is formed from aluminum or sheet steel and has a female threaded section which is designed to retain a conventional voice diaphragm 20 and perforated cover 21 in the emitter passage. Voice diaphragm 20 provides conventional speech capabilities for the mask user.

To provide enhanced communication with other people in the area, a voice transmission system, indicated generally at 30 in FIGS. 1–5, can be releasably coupled to the voice emitter passage 10 of the mask. The voice transmission system 30 includes a microphone, indicated generally at 32, a speaker, indicated generally at 33, and an amplifier assembly, indicated generally at 34. The microphone 32, speaker 33 and amplifier assembly 34 are mounted to and at least partially enclosed by an integrally molded lightweight plastic body 36.

The body 36 of the voice transmission system includes a main compartment, indicated generally at 38, having side walls 39 and end wall 40. The main compartment 38 houses the amplifier assembly 34, which includes a control switch 44 (FIG. 1) and an amplifier circuit board 46. The control switch 44 for the present invention preferably comprises a switch element partially enclosed in a rubber boot. A preferred rubber boot for the present invention is sold by Multi-Flex Seals, Inc. of Hackensack, N.J., under Model No. 40084; while a switch element is sold by A.S.C. of Wakefield, Mass. under Model No. 401ZQE. A portion of the control switch 44 extends outwardly from the housing and is enclosed by the rubber boot. The switch 44 is selectively actuatable by the user to control the operation of the voice transmission system.

The circuit board 46 for the amplifier assembly is retained within main compartment 38 by a sheet metal screw 47, which is received within threaded post 48 extending inwardly from the end wall 40 of body 36. The circuit board includes capacitors, resistors and other electrical components which filter and amplify the user's voice received in microphone 32. The circuit board in turn provides an amplified signal to the speaker 33, also located within the main compartment. The electrical components for the amplifier assembly are described in more detail in U.S. application Ser. No. 07/433,601, filed Nov. 8, 1989 entitled "Voice Transmission System", and assigned to the assignee of the present invention, which is incorporated herein by reference.

The speaker 33 for the voice transmission system is located in a shoulder 50 formed around the outer lip 51 of main compartment 38. The speaker receives the amplified signal from the circuit board 46 and externally transmits the amplified signal. Preferably, speaker 33 is a four ohm, two watt speaker produced by the Quam-Nichols Company, Chicago, Ill.

The speaker 33 and amplifier assembly 34 are enclosed within the main compartment by a removable end cap 52, which is threadedly mounted to the outside of the body 36. A speaker cloth 53 is located between speaker 33 and end cap 52. The end cap 52 also retains rubber annular gaskets 55, 56 on opposite sides of the outer rim or flange 58 of speaker 33. Gaskets 55, 56 provide a watertight and airtight seal between the end cap 50 and body 36. The end cap 52 is perforated as indicated at 59 to enable the user's voice to be externally transmitted from the speaker.

The body further includes a microphone cavity 60 formed by an annular sidewall 62 protruding outwardly from the end wall 40. The microphone cavity 60 is configured to receive and at least partially enclose the microphone 32. Preferably, microphone 32 is disposed in a bed of foam rubber 66 to dampen vibrations, minimize feedback and enhance sound quality. Located in front of microphone 32 is a circular piece of speaker cloth 68, a perforated metal microphone grill 69, and an annular plastic washer 70 which are compression-fitted into the microphone cavity 60. A preferred microphone for the present invention is sold by Primo Microphone Inc., of Bensenville, Ill., a division of Primo Company, Ltd. of Tokyo, Japan, under part no. EM78.

Figure 6:
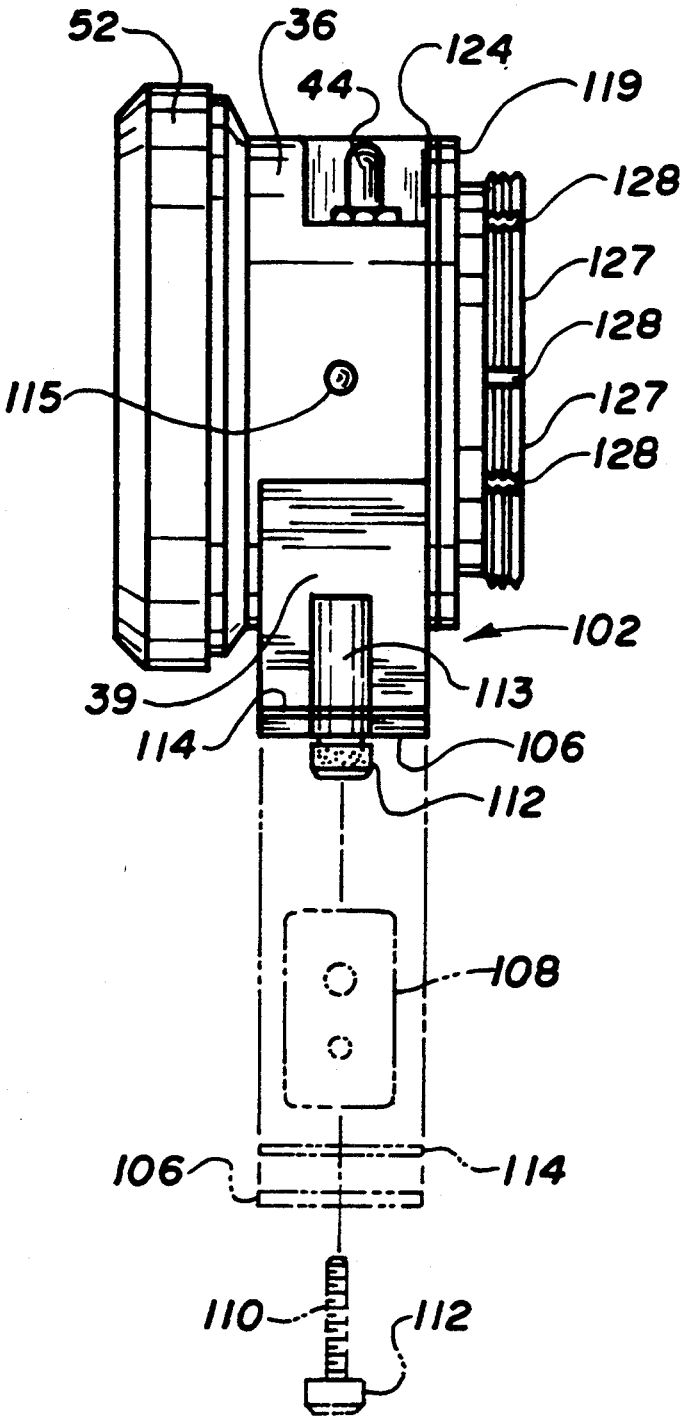
FIG. 6 is a side view of the voice transmission system illustrated in FIG. 3.

Referring now to FIGS. 2 and 6, a rectangular battery compartment, indicated generally at 102, is integrally formed with and positioned along the bottom of the body 36. The battery compartment 102 is partially formed by sidewalls 39 of body 36 and is easily externally accessible. To this end, compartment 102 includes a removable cover 106 which provides access to a battery 108 contained in the compartment. The battery 108 is electrically interconnected with the amplifier assembly 34, microphone 32, speaker 33 and switch 44.

Preferably, battery 108 comprises a commercially-available, replaceable, nine-volt alkaline battery. Cover 106 is held securely to compartment 102 by machine screws 110 which include oversized knurled heads 112 to allow easy grasping by a user's fingers. Machine screws 110 are threadedly received within internally threaded posts 113 formed along the sidewall 39 of compartment 102. Further, in order to ensure that the compartment 102 is watertight, preferably a rubber gasket 114 is interposed between cover 106 and side walls 39. Gasket 114 is disposed along the edges of cover 106 and forms a seal with the bottom ends 115 of the side walls 39 of the compartment.

By rotating threaded machine screws 110 in the counterclockwise direction, the cover 106 is easily removed. With the cover removed, battery 108 can be replaced while the voice transmission system 30 is mounted to the mask and the mask is positioned on a user's face. The cover 106 is easily remounted upon the battery compartment 102 by aligning the ends of screws 110 with the posts 113, and turning the screws 110 in the clockwise direction.

A light indicator of LED 115 can also be included along the outside of the body 36. The light indicator or LED is illuminated when switch 44 is located in the "on" position. LED 115 provides an additional function in that if switch 44 is place in the "on" position and the batteries are weak, LED will not light. An example of an LED suitable for use with the present invention is a LED sold by Hewlett Packard under part number HLMP D150.

Figure 5:
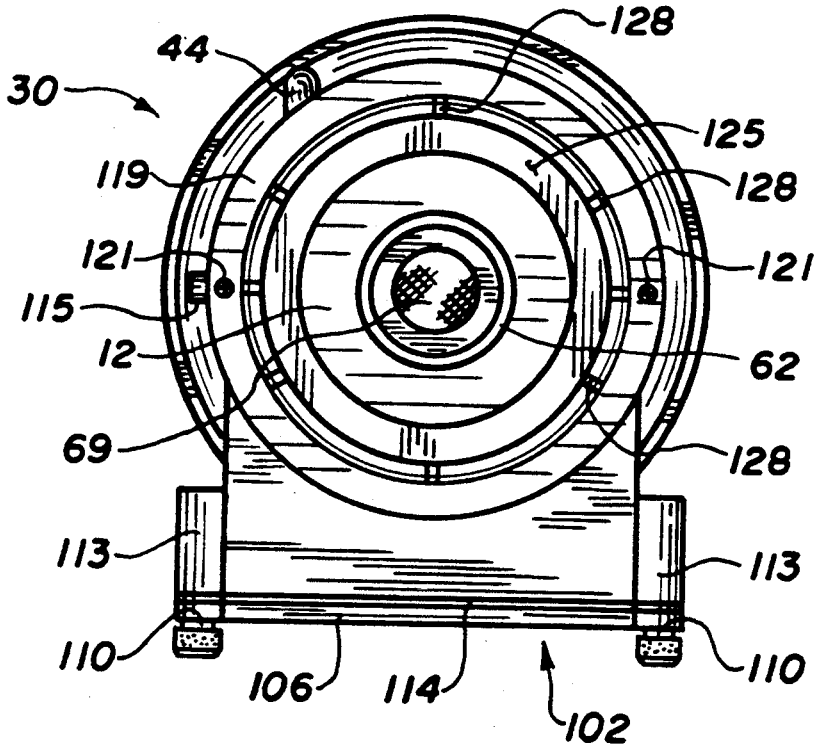
FIG. 5 is a rear view of the voice transmission system illustrated in FIG. 3.
Figure 7:
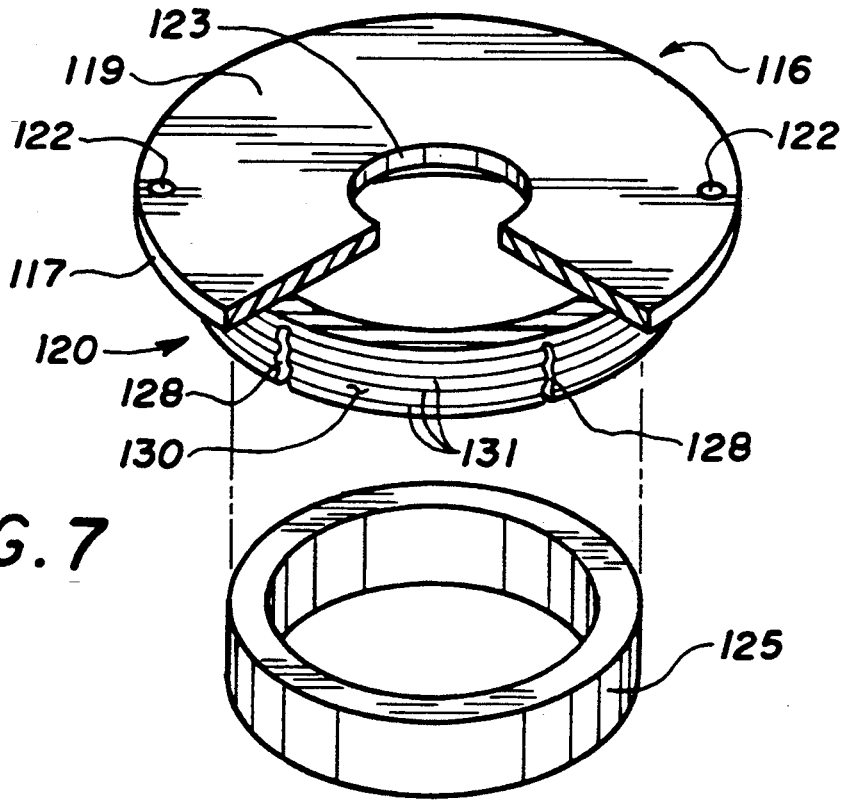
FIG. 7 is a perspective view of the mounting assembly for the voice transmission system.

Referring now to FIGS. 2 and 7, the voice transmission system 30 further includes a mounting assembly, indicated generally at 116, which facilitates attachment of the body 36 to the mask 5 (FIG. 1). The mounting assembly includes a bracket 117, which has a circular base plate 119 and an outwardly extending, annular mounting collar, indicated generally at 120. The bracket 117 is preferably integrally formed from relatively rigid plastic material and is secured to body 36 using a plurality of machine screws 121 (FIG. 5). The machine screws 121 are threadedly received in star nuts (not shown) molded into the end wall of body 36, while the heads of screws 121 seat in holes 122 formed around the periphery of base plate 119. It will be appreciated that although bracket 117 and body 36 are shown as separate pieces, the present invention contemplates forming body 36 and bracket 117 as a single piece.

Bracket 117 further includes an opening 123 formed in base plate 119. Opening 123 is configured to locate around and receive the annular sidewall 62 of the microphone cavity 60. Located between body 36 and bracket 117 is a gasket 124 which helps to ensure a watertight and airtight seal between the bracket 117 and the end wall 40 of body 36. Gasket 124 also serves to dampen the transmission of vibrations between body 36 and bracket 117. Also included in abutment with one side of base plate 119 and the voice diaphragm is an annular foam rubber gasket 125, which is received within annular mounting collar 120. Gasket 125 facilitates sound reproduction and minimizes feedback by dampening the transmission of vibrations from the mask 5 to the bracket 117 and by providing a watertight and airtight seal between the bracket 117 and the mask 5.

The collar 120, formed in one piece toward the periphery of base plate 119 and extending outwardly therefrom, is defined by a plurality of flexible, arcuate segments 127 cooperatively arranged in a circular manner. Each segment 127 in the collar is separated by a groove 128 from its next adjacent segment. The segments 127 include an outer surface 130 having raised, annular helical ridges 131 formed thereon which conform substantially to the inner threads on diaphragm insert 14 in voice emitter passage 10. However, the outer dimension of the annular ridges 131 of the segments is slightly larger than the inner dimension of the threads on the diaphragm insert in the voice emitter passage. Accordingly, upon insertion of the bracket within the voice emitter passage of the mask, the segments 127 resiliently deflect radially inwardly during assembly and thereafter radially expand and tightly engage the threads on the diaphragm insert. The annular ridges on the segments are designed to engage the threads on the diaphragm insert with a predetermined amount of resistance to couple the voice transmission system to the mask and prevent unwanted removal therefrom.

The voice transmission system 30 is attached to the mask 5 by first grasping and aligning the body 36 relative to the voice emitter passage 10 of the mask 5, and inserting the collar 120 within the diaphragm insert 14 of the voice emitter passage 10. The voice transmission system can be coupled to the voice emitter passage in the mask by applying an inwardly-directed force against the body and "popping" the bracket into the voice emitter passage. Likewise, the voice transmission system can be removed from the voice emitter passage by pulling outwardly on the body 36 to overcome the resistance of the segments against the diaphragm insert in the voice emitter passage. This feature makes the voice transmission system particularly suited for situations where the hands of the user are enclosed in bulky gloves or mittens. Moreover, it is believed that this feature provides additional safety for the mask user if the voice transmission system is struck from the side by an object e.g., a tree branch. In this case, the voice transmission system will automatically disconnect i.e., "pop out" from the voice emitter passage in the mask without pulling the mask off the face of the user.

The annular ridges 131 on the annular segments can also form male threads which match the female threads on the voice emitter passage. The male threads allow the mounting bracket 116 of the voice transmission system to be "screwed" into the diaphragm insert of the voice emitter passage. In this case, to remove the voice transmission system from the mask, the mounting bracket can likewise be "unscrewed" from the voice emitter passage 10, or alternatively "popped out" from the emitter passage, as described above. In any case, the voice transmission system can be easily coupled to and uncoupled from the voice emitter passage in the mask without penetrating or structurally altering the mask.

After the voice transmission system is installed on the mask, the user need only manually engage the control switch 44 to activate the system. When the system is activated, the microphone 32 of the voice transmission system 30 is designed to receive the mask user's voice through voice diaphragm 20. The signal from the microphone is amplified in the amplifier assembly 46 and externally transmitted through the speaker 33. If the batteries powering the system become weak, the batteries cover can be easily removed and the battery replaced.

Although the invention has been shown and described with respect to a certain preferred embodiment, it is obvious that equivalent alterations and modifications will occur to others skilled in the art upon their reading and understanding of the specification. The present invention includes all such equivalent alterations and modifications, and is limited only by the scope of the following claims.

What is claimed is:

1. A voice transmission system for a protective mask having a voice emitter passage having an inner end proximate a mouth of a person wearing the mask, and an outer end having a voice diaphragm integral therewith, the voice transmission system comprising:

a body mounting and substantially enclosing a microphone to receive the person's voice through the voice diaphragm, an amplifier assembly to amplify the received voice, and a speaker to transmit the amplified voice, said body further including a battery compartment adapted to contain a battery and having a selectively removable cover to allow access to and replacement of the battery, wherein the battery, amplifier assembly, microphone and speaker are electrically interconnected when the battery is located in the battery compartment, and a mounting bracket attached to said body, said mounting bracket including a first mounting portion, and the voice emitter passage including a second mounting portion, one of said first or second mounting portions being resiliently deflectable for coupling and uncoupling said body to the voice emitter passage to enable the voice transmission system to receive, amplify and externally transmit the person's voice received through the voice diaphragm.

2. The voice transmission system as in claim 1, wherein said mounting portions are adapted to couplingly engage with a predetermined amount of resistance, and adapted to resiliently deflect to uncouple such that said body can be coupled to the outer end of the voice emitter passage by forcing said mounting bracket axially inward into the voice emitter passage, and be uncoupled from the outer end of the voice emitter passage by a force applied laterally to the body of the voice transmission system.

3. The voice transmission system as in claim 2, wherein one of said mounting portions includes raised ridges adapted to engage corresponding raised ridges on the other of said mounting portions when said mounting bracket is located within the outer end of the voice emitter passage.

4. The voice transmission system as in claim 3, wherein one of said mounting portions includes a plurality of resiliently deflectable members which deflect to couple and uncouple said mounting bracket to the outer end of the voice emitter passage.

5. The voice transmission system as in claim 4, wherein said resiliently deflectable members comprise resilient arcuate segments separated by grooves.

6. The voice transmission system as in claim 5, wherein said mounting bracket includes a base plate, and said resilient segments are formed in one piece with said base plate and extend outwardly therefrom to cooperatively form a segmented, annular collar.

7. The voice transmission system as in claim 6, wherein said resilient segments have annular ridges, and the voice emitter passage has corresponding threaded segments, said annular ridges on said resilient segments adapted to engage the threaded segments on the voice emitter passage.

8. The voice transmission system as in claim 7, wherein said annular ridges on said resilient segments form threads to enable said mounting bracket to be screwed into and unscrewed from the voice emitter passage of the mask.

9. The voice transmission system as in claim 8, wherein said base plate is attached to said body.

10. The voice transmission system as in claim 9, wherein said base plate is substantially circular in top plan view.

11. The voice transmission system as in claim 10, wherein said body further includes a resilient gasket, said resilient gasket being located within said annular collar to seal said base plate to the voice diaphragm in the voice emitter passage.

12. The voice transmission system as in claim 11, wherein said base plate includes an aperture to enable the person's voice to be transmitted through the voice diaphragm to the microphone.

13. The voice transmission system as in claim 12, wherein said aperture in said base plate is configured to at least partially receive a portion of said body which encloses said microphone.

14. The voice transmission system as in claim 13, wherein said amplifier assembly includes a switch assembly, said switch assembly selectively actuating said microphone, speaker and amplifier assembly to receive amplify and externally transmit the user's voice.

15. A voice transmission system for use with a protective mask having a voice emitter passage and a voice diaphragm mounted within the voice emitter passage, said voice transmission system comprising:

a body mounting and substantially enclosing an amplifier assembly and a speaker within a main compartment and at least partially enclosing a microphone within a microphone cavity, said amplifier assembly, speaker and microphone being electrically interconnected and selectively actuatable to receive, amplify and transmit a user's voice.

a mounting bracket attached to said body, said mounting bracket including a first mounting portion and the voice emitter passage including a second mounting portion, at least one of said first or second mounting portions being resiliently deflectable for coupling and uncoupling said mounting bracket proximate a person's mouth without penetrating or structurally modifying the mask to receive, amplify and externally transmit the person's voice.

16. The voice transmission system as in claim 15, wherein said mounting portions are adapted to couplingly engage with a predetermined amount of resistance with said mounting bracket located within an outer end of the voice emitter passage, and further adapted to resiliently deflect during uncoupling of said mounting bracket such that said mounting bracket can be coupled to the outer end of the voice emitter passage by forcing said mounting bracket axially inward into the voice emitter passage, and can be uncoupled from the outer end of the voice emitter passage by a force applied laterally to the body of the voice transmission system.

17. The voice transmission system as in claim 16, wherein one of said mounting portions includes raised ridges adapted to engage corresponding raised ridges on the other of said mounting portions when said mounting bracket is located within the outer end of the voice emitter passage.

18. The voice transmission system as in claim 17, wherein one of said mounting portions includes a plurality of resiliently deflectable members for coupling and uncoupling said mounting bracket within the outer end of the voice emitter passage.

19. The voice transmission system as in claim 18, wherein said resiliently deflectable members comprise resilient arcuate segments separated by grooves.

20. The voice transmission system as in claim 19, wherein said mounting bracket includes a base plate, and said resilient segments are formed on said base plate and extend outwardly therefrom to cooperatively form a segmented, annular collar.

21. A voice transmission system for a face mask having a voice emitter passage with an inner end proximate a person's mouth wearing the mask and an outer end having a voice diaphragm integral therewith, said voice transmission system comprising:

a body at least partially enclosing: 1) a microphone for receiving a person's voice through said voice diaphragm, 2) an amplifier assembly for amplifying the received voice, and 3) a speaker for transmitting the amplified voice externally of the mask, said body further including a battery compartment adapted to contain a battery and having a selectively removable cover to allow access to and replacement of the battery, the battery being electrically interconnected with said microphone, speaker and amplifier assembly when located within said battery compartment, and a mounting bracket attached to said body, said mounting bracket including a first mounting portion and said voice emitter passage including a second mounting portion, said first mounting portion adapted to engage said second mounting portion with a predetermined amount of resistance to enable said mounting bracket to be coupled and uncoupled to the outer end of the voice emitter passage.

22. The voice transmission system as in claim 21, wherein one of said first or second mounting portions is adapted to resiliently deflect during coupling of said mounting bracket to the outer end of the voice emitter passage, and wherein said mounting portions are adapted to couplingly engage with a predetermined amount of resistance so that said mounting bracket is coupled to the outer end of the voice emitter passage, and wherein said mounting portions are adapted to resiliently deflect during uncoupling of said mounting bracket such that said mounting bracket can be coupled to the outer end of the voice emitter passage by forcing said mounting bracket axially inward into the voice emitter passage, and can be uncoupled from the outer end of the voice emitter passage when a force is applied to the body of the voice transmission system.

23. The voice transmission system as in claim 22, wherein one of said first or second mounting portions includes raised ridges adapted to engage corresponding raised ridges on the other of said first or second mounting portions when said mounting bracket is coupled to the outer end of the voice emitter passage.

24. The voice transmission system as in claim 23, wherein one of said first or second mounting portions includes a plurality of resiliently deflectable members for coupling and uncoupling said mounting bracket to the outer end of the voice emitter passage.

25. The voice transmission system as in claim 24, wherein said resiliently deflectable members comprise resilient arcuate segments separated by grooves.

26. The voice transmission system as in claim 25, wherein said mounting bracket includes a base plate, and said resilient segments are formed on said base plate and extend outwardly therefrom to cooperatively form a segmented, annular collar.

27. A voice transmission system for use with a protective mask, comprising:

a body mounting and substantially enclosing an amplifier assembly and a speaker within a main compartment and at least partially enclosing a microphone within a microphone cavity, said amplifier assembly, speaker and microphone being electrically interconnected and selectively actuatable to receive, amplify and transmit a user's voice, and a mounting bracket attached to said body and including a resilient mounting portion, the mask including a mask mounting portion for receiving said resilient mounting portion, said resilient mounting portion and said mask mounting portion resiliently cooperating to enable the voice transmission system to be resiliently coupled to the mask, and to be resiliently uncoupled from the mask by a force applied to the body of the voice transmission system, whereby said resilient mounting portion deflects radially inward upon insertion into the mask mounting portion.

28. The voice transmission system as in claim 27, wherein said resilient mounting portion engages said mask mounting portion by resistance when said mounting bracket is coupled to said mask, and said resilient mounting portion resiliently deflects to uncouple from said mounting bracket from the mask such that said mounting bracket can be coupled to an outer end of the voice emitter passage by forcing said mounting bracket axially inward into the voice emitter passage and can be uncoupled by pulling said mounting bracket axially out of said voice emitter passage.

29. The voice transmission system as in claim 28, wherein said resilient mounting portion includes raised ridges adapted to engage cooperating raised ridges on the mask mounting portion when said mounting bracket is coupled to the mask.

30. A voice transmission system for use with a protective mask having a voice emitter passage adjacent the mouth of a person wearing the mask and a voice diaphragm integral therewith, said voice transmission system comprising:

a body substantially enclosing an amplifier assembly and a speaker within a main compartment and partially enclosing a microphone assembly within a microphone cavity such that said microphone assembly has an external portion which is exposed, said amplifier assembly, speaker and microphone assembly being electrically interconnected by an electrical circuit and being selectively actuatable to receive, amplify and transmit a user's voice, said body connected to a portion which cooperates with the mask to couple the voice transmission system to the mask and to position the exposed external portion of the microphone assembly enclosed by the body adjacent the person's mouth so that the person's voice is guided only by the voice emitter passage through the diaphragm to the microphone assembly which receives, amplifies, and externally transmits the person's voice.

31. The voice transmission system as in claim 30, wherein the portion of the body which cooperates with the mask includes a mounting bracket having a resilient mounting portion, said resilient mounting portion resiliently cooperating with the mask to enable the voice transmission system to be coupled to the mask without rotating the body so that the mounting bracket can be coupled to an outer end of the voice emitter passage by forcing the mounting bracket axially inward into the voice emitter passage, and can be uncoupled from the mask without rotating the body, by applying a force to the body of the voice transmission system.

32. The voice transmission system as in claim 30, wherein the body includes a main compartment sidewall which extends outwardly from and is formed integrally with one side of an endwall to define the main compartment, and a microphone cavity sidewall which extends outwardly from and is formed integrally with another side of said endwall to define and position the microphone cavity proximate the voice emitter passage.

33. The voice transmission system as in claim 30, wherein the microphone assembly includes a microphone, foam rubber surrounding a portion of the microphone, and a perforated grill enclosing the microphone in the microphone cavity.

34. The voice transmission system of claim 30 wherein said portion of said body which cooperates with the mask to couple the voice transmission system to the mask is an annular mounting collar.

35. A voice transmission system for a protective face mask having a voice emitter passage forming an extension of the face mask with a voice diaphragm integral therewith, said voice transmission system comprising:

a body mounting and substantially enclosing an amplifier assembly and a speaker within an open-ended main compartment and at least partially enclosing a microphone within a microphone cavity which serves to receive and amplify the person's voice, and a battery compartment adapted to contain a battery;

said amplifier assembly, speaker, battery and microphone being interconnected by an electrical circuit; and a mounting bracket integral with said body, said mounting bracket having a mounting device for removably coupling the voice transmission system to the voice emitter passage to receive, amplify and transmit the person's voice received through the voice diaphragm.

36. The voice transmission system as in claim 35, wherein said mounting bracket is connected to said body.

37. A voice transmission system for use with a conventional protective face mask having a voice emitter passage with its inner end proximate a person's mouth wearing the mask and its outer end having a voice diaphragm integral therewith, said voice transmission system comprising:

a body mounting and substantially enclosing an amplifier assembly and a speaker within a main compartment and at least partially enclosing a microphone within a microphone cavity;

an electrical circuit interconnecting said amplifier assembly, speaker and microphone with at least one battery, and a mounting bracket attached to said body, said mounting bracket having a mounting device for removably coupling said voice transmission system to the mask proximate the person's mouth without penetrating or structurally modifying the mask.

38. The voice transmission system of claim 37 wherein said mounting device is an annular mounting collar.

39. A voice transmission system for a face mask having a voice emitter passage with its inner end proximate a person's mouth wearing the mask and its outer end having a voice diaphragm integral therewith, said voice transmission system comprising:

a body at least partially enclosing: 1) a microphone for receiving a person's voice through said voice diaphragm, 2) an amplifier assembly for amplifying the received voice, and 3) a speaker for transmitting the amplified voice externally of the mask, said body further including a battery compartment adapted to contain a battery, the battery being electrically interconnected with said microphone, speaker and amplifier assembly when located within said battery compartment, and a mounting bracket attached to said body, said mounting bracket including a first threaded mounting portion and said voice emitter passage including a second threaded mounting portion, said first threaded mounting portion being adapted to engage said second threaded mounting portion to enable said mounting bracket to be coupled to and uncoupled from the outer end of the voice emitter passage without moving the voice diaphragm from the outer end of the voice emitter passage.

40. A voice transmission system for use with a protective mask having a voice emitter passage and a voice diaphragm mounted within the voice emitter passage, said voice transmission system comprising a body selectively and removably coupled to said voice emitter passage without removing the voice diaphragm, said body mounting and at least partially enclosing a microphone, amplifier and speaker which are electrically interconnected with one another, whereby a voice of a user passes through said voice emitter passage and diaphragm to the microphone for amplification and transmission through the speaker.

41. A voice transmission system for use with a protective mask having a voice emitter passage and a voice diaphragm mounted within the voice emitter passage, said voice transmission system comprising, (i) a body mounting and at least partially enclosing a microphone, amplifier and speaker which are electrically interconnected with one another, and (ii) an adaptor member disposed intermediate the voice emitter passage and said body, said adaptor member secured at one end to said body and selectively attached at an opposite end to the voice emitter passage without removing the voice diaphragm, whereby a voice of a user passes through said voice emitter passage and diaphragm to the microphone for amplification and transmission through the speaker.

* * * * *